US010923081B2

(12) United States Patent
Wu et al.

(10) Patent No.: US 10,923,081 B2
(45) Date of Patent: Feb. 16, 2021

(54) TIMING CONTROLLER, DISPLAY APPARATUS, AND OPERATION METHOD THEREOF

(71) Applicants: Tzu-Yi Wu, Kaohsiung (TW); Ming-Hsun Sung, Hsinchu County (TW)

(72) Inventors: Tzu-Yi Wu, Kaohsiung (TW); Ming-Hsun Sung, Hsinchu County (TW)

(73) Assignee: ITE Tech. Inc., Hsinchu (TW)

( * ) Notice: Subject to any disclaimer, the term of this patent is extended or adjusted under 35 U.S.C. 154(b) by 0 days.

(21) Appl. No.: 16/408,451

(22) Filed: May 9, 2019

(65) Prior Publication Data

US 2020/0258476 A1 Aug. 13, 2020

(30) Foreign Application Priority Data

Feb. 12, 2019 (TW) ..... 108104636 A

(51) Int. Cl.

| | |
|---|---|
| ***G09G 5/18*** | (2006.01) |
| ***G09G 5/00*** | (2006.01) |
| ***G09G 3/36*** | (2006.01) |
| ***G09G 3/20*** | (2006.01) |

(52) U.S. Cl.

CPC ..... *G09G 5/18* (2013.01); *G09G 3/2074* (2013.01); *G09G 3/3618* (2013.01); *G09G 5/006* (2013.01); *G09G 2310/08* (2013.01)

(58) Field of Classification Search

CPC .... G09G 5/10; G09G 2320/0626; G09G 5/18; G09G 5/02; G09G 2354/00; G09G 2320/0666; G09G 2360/16; G09G 2320/0233; G09G 3/20; G09G 2320/066

See application file for complete search history.

(56) References Cited

U.S. PATENT DOCUMENTS

| | | | | |
|---|---|---|---|---|
| 6,411,302 | B1 * | 6/2002 | Chiraz | G06F 3/1431 345/531 |
| 6,657,636 | B2 * | 12/2003 | Pether | G06F 13/28 345/562 |
| 9,177,533 | B2 * | 11/2015 | Fink | G09G 5/393 |
| 2004/0085322 | A1 * | 5/2004 | Alcorn | G06T 15/005 345/562 |

(Continued)

*Primary Examiner* — Olga V Merkoulova

(74) *Attorney, Agent, or Firm* — JCIPRNET

(57) ABSTRACT

A timing controller, a display apparatus, and an operation method thereof are provided. The display apparatus includes a display panel and a timing controller. The timing controller includes a refresh mark controller and a pixel controller. The refresh mark controller includes a refresh mark table, and a plurality of refresh marks in the refresh mark table correspond to a plurality of sub-regions of a display region in the display panel. The refresh mark controller determines whether the sub-regions need to be refreshed according to an image signal and responds to a specific sub-region required to be refreshed to adjust a specific refresh mark according to a mapping ratio. The pixel controller sequentially looks up whether the refresh marks in the refresh mark table are adjusted, obtains the sub-regions corresponding to the adjusted refresh marks according to the mapping ratio, and performs a pixel refresh operation to the sub-regions.

22 Claims, 8 Drawing Sheets

(56) References Cited

U.S. PATENT DOCUMENTS

| | | | | |
|---|---|---|---|---|
| 2004/0100472 | A1* | 5/2004 | Linzer | G09G 5/39 345/536 |
| 2004/0140978 | A1* | 7/2004 | Suh | G06T 1/60 345/544 |
| 2010/0220122 | A1* | 9/2010 | Zehner | G09G 5/18 345/690 |
| 2016/0155407 | A1* | 6/2016 | Gass | G09G 3/3648 345/691 |
| 2019/0043167 | A1* | 2/2019 | Steyskal | G06T 3/4038 |

* cited by examiner

TIMING CONTROLLER, DISPLAY APPARATUS, AND OPERATION METHOD THEREOF

CROSS-REFERENCE TO RELATED APPLICATION

This application claims the priority benefit of Taiwan application serial no. 108104636, filed on Feb. 12, 2019. The entirety of the above-mentioned patent application is hereby incorporated by reference herein and made a part of this specification.

BACKGROUND

Technical Field

The disclosure relates to a timing controller, a display apparatus, and an operation method thereof. More particularly, the disclosure relates to a timing controller, a display apparatus, and an operation method thereof requiring reduced memory space.

Description of Related Art

When processing a plurality of display regions, a display controller uses each of the registers to store information of each of the display regions. That is, when the display panel begins displaying, the display controller uses a counter to begin counting from the top left to the bottom right of the screen regions and determines whether the screen regions are required to be displayed at the same time. If the screen regions are required to be displayed, the display controller accesses the corresponding pixel information to output a driving signal to the driving circuit.

The display controller may require each of the registers to store a plurality pieces of regional information, but if the display controller needs to support multiple display regions (e.g., 64 display regions) and the size of the display panel is relatively large (e.g., the size of the display panel may be 1024*1024 pixels), the display controller may need much memory space (e.g., may need to use registers of about 2560 bits). Further, the counter can perform counting only from the top left to the bottom right. Therefore, significantly large memory space is required, the circuit structure is thereby large and complex, and efficiency of searching for effective pixel information is relatively slow.

SUMMARY

The disclosure provides a timing controller, a display apparatus, and an operation method thereof having a simple circuit structure, requiring less memory space, and capable of enhancing efficiency of searching for effective pixel information.

The disclosure provides a display apparatus including a display panel and a timing controller. The display panel includes a display region. The timing controller is coupled to the display panel, and the timing controller receives an image signal and uses the display panel to display the image signal. The timing controller includes a refresh mark controller and a pixel controller. The refresh mark controller includes a refresh mark table. A plurality of refresh marks in the refresh mark table correspond to a plurality of sub-regions of the display region. A mapping ratio is provided between the refresh mark table and the display region. The refresh mark controller determines whether the sub-regions are required to be refreshed according to the image signal and responds to a specific sub-region required to be refreshed to adjust a specific refresh mark according to the mapping ratio. The specific refresh mark is located in the refresh mark table and corresponds to the specific sub-region. The pixel controller is coupled to the refresh mark controller. The pixel controller sequentially looks up whether the refresh marks in the refresh mark table are adjusted, obtains the sub-regions corresponding to the adjusted refresh marks according to the mapping ratio, and performs a pixel refresh operation to the sub-regions.

The disclosure provides a timing controller adapted to receive an image signal and use a display panel of a display apparatus to display the image signal. The timing controller includes a refresh mark controller and a pixel controller. The refresh mark controller includes a refresh mark table. A plurality of refresh marks in the refresh mark table correspond to a plurality of sub-regions of the display region. A mapping ratio is provided between the refresh mark table and the display region. The refresh mark controller determines whether the sub-regions are required to be refreshed according to the image signal and responds to a specific sub-region required to be refreshed to adjust a specific refresh mark according to the mapping ratio. The specific refresh mark is located in the refresh mark table and corresponds to the specific sub-region. The pixel controller is coupled to the refresh mark controller. The pixel controller sequentially looks up whether the refresh marks in the refresh mark table are adjusted, obtains the sub-regions corresponding to the adjusted refresh marks according to the mapping ratio, and performs a pixel refresh operation to the sub-regions.

The disclosure further provides an operation method of a display apparatus, and the operation method includes: setting a plurality of refresh marks in a refresh mark table of the refresh mark controller to correspond to a plurality of sub-regions in a display region of the display panel; setting a mapping ratio between the refresh mark table and the display region to be provided; determining whether the sub-regions are refreshed according to an image signal, responding to a specific sub-region required to be refreshed to adjust a specific refresh mark according to the mapping ratio, the specific refresh mark located in the refresh mark table and corresponding to the specific sub-region; sequentially looking up whether the refresh marks in the refresh mark table are adjusted; and obtaining the sub-regions corresponding to the adjusted refresh marks according to the mapping ratio and performing a pixel refresh operation to the sub-regions.

To sum up, in the disclosure, the display apparatus uses the timing controller to receive the image signal. The refresh mark controller is then used to determine whether the sub-regions in the display region in the display panel are required to be refreshed according to the image signal and responds to the specific sub-region required to be refreshed to adjust the specific refresh mark according to the mapping ratio. Next, the pixel controller is further used to sequentially look up whether the refresh marks in the refresh mark table are adjusted, obtains the sub-regions corresponding to the adjusted refresh marks according to the mapping ratio, and performs the pixel refresh operation to the sub-regions. Accordingly, the sub-regions in the display region are managed through the refresh marks requiring less memory capacity, and in this way, the circuit structure is simplified, less memory space is used, and efficiency of searching for the effective pixel information is enhanced.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1A:
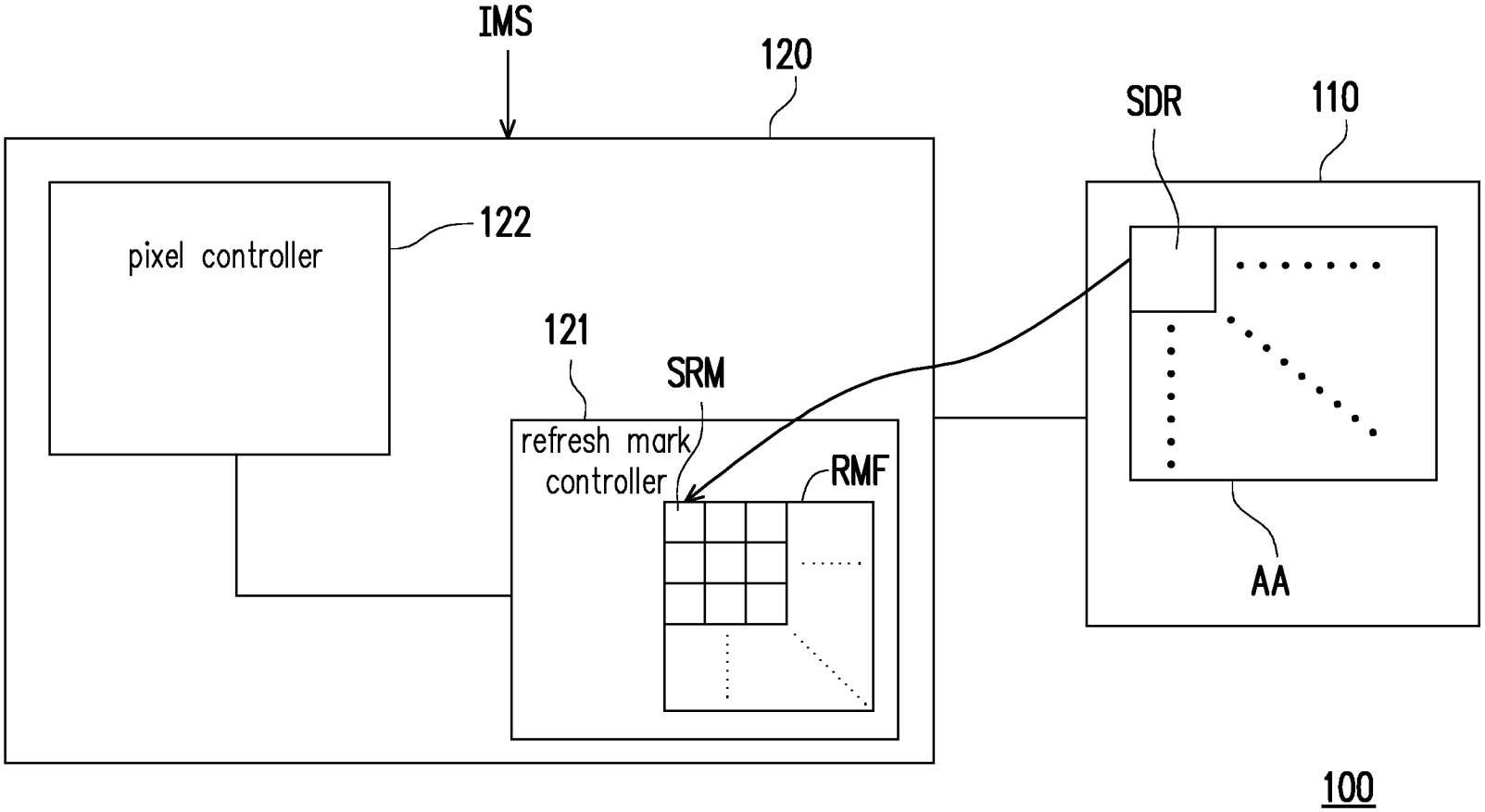
FIG. 1A is a schematic diagram illustrating a display apparatus according to an embodiment of the disclosure.

With reference to FIG. 1A, FIG. 1A is a schematic diagram illustrating a display apparatus according to an embodiment of the disclosure. A display apparatus 100 includes a display panel 110 and a timing controller 120. The display panel 110 has a display region AA, and the display region AA includes a plurality of sub-regions (e.g., a sub-region SDR). The display apparatus 100 is, for example, an e-paper electronic apparatus, and the display panel 110 is, for example, a bistable display panel, and which should not be construed as limitations to the disclosure. Note that in order to simplify the illustration, only 1 sub-region SDR is depicted in FIG. 1A to act as an exemplary example. Nevertheless, the disclosure does not intend to limit a number of the sub-regions in the display region in practice, and people having ordinary skill in the art may make adjustment according to actual applications. In addition, the timing controller 120 is coupled to the display panel 110, and the timing controller 120 receives an image signal IMS and uses the display panel 110 to display the image signal IMS.

Specifically, the timing controller 120 includes a refresh mark controller 121 and a pixel controller 122. The refresh mark controller 121 includes a refresh mark table RMF, and the refresh mark table RMF includes a plurality of refresh marks (e.g., a refresh mark SRM). The refresh marks in the refresh mark table RMF correspond to the sub-regions in the display region AA. Note that in order to simplify the illustration, only 1 refresh mark SRM is depicted in FIG. 1A as well to act as an exemplary example. Nevertheless, the disclosure does not intend to limit a number of the refresh marks in the refresh mark table in practice, and people having ordinary skill in the art may make adjustment according to actual applications.

Note that the sub-regions and the refresh marks are correspondingly related in this embodiment, and one sub-region in the display region AA may correspond to multiple refresh marks in the refresh mark table RMF or may correspond to only one refresh mark in the refresh mark table RMF, which is not limited by the disclosure in this regard, and people having ordinary skill in the art may make adjustment according to actual applications.

In addition, a mapping ratio is provided between the refresh mark table RMF and the display region AA. The mapping ratio is a zoom scale factor of the refresh marks in the refresh mark table RMF to the sub-regions in the display region AA. The refresh mark controller 121 determines whether the sub-regions in the display region AA are required to be refreshed according to the image signal IMS and responds to a specific sub-region required to be refreshed to adjust a specific refresh mark according to the mapping ratio. The specific refresh mark is located in the refresh mark table RMF and corresponds to the specific sub-region. In other words, the refresh mark controller 121 of this embodiment may determine whether the sub-regions in the display region AA are required to be refreshed according to the image signal IMS received by the timing controller 120. That is, the refresh mark controller 121 may identify the sub-regions in the display region AA that need to be displayed according to the image signal IMS and treats at least one of the sub-regions that need to be refreshed as the specific sub-region. Next, the refresh mark controller 121 responds to the specific sub-region to identify the specific refresh mark corresponding to the specific sub-region among the refresh marks according to the mapping ratio and adjusts the specific refresh mark. The specific refresh mark is at least one of the refresh marks.

From another perspective, the pixel controller 122 is coupled to the refresh mark controller 121. The pixel controller 122 sequentially looks up whether the refresh marks in the refresh mark table RMF are adjusted, obtains the sub-regions corresponding to the adjusted refresh marks according to the mapping ratio, and performs a pixel refresh operation to the sub-regions. In other words, the pixel controller 122 sequentially looks up the refresh marks in the refresh mark table RMF to look up whether a numerical value in each of the refresh marks is adjusted, obtains at least one of the sub-regions corresponding to at least one of the adjusted refresh marks according to the mapping ratio after identifying at least one of the adjusted refresh marks, and performs the pixel refresh operation to at least one of the sub-regions. Next, after the pixel controller 122 completes the pixel refresh operation to at least one of the sub-regions, the pixel controller 122 modifies at least one of the refresh mark corresponding to at least one of the sub-regions from an adjusted state to an unadjusted state.

Figure 1B:
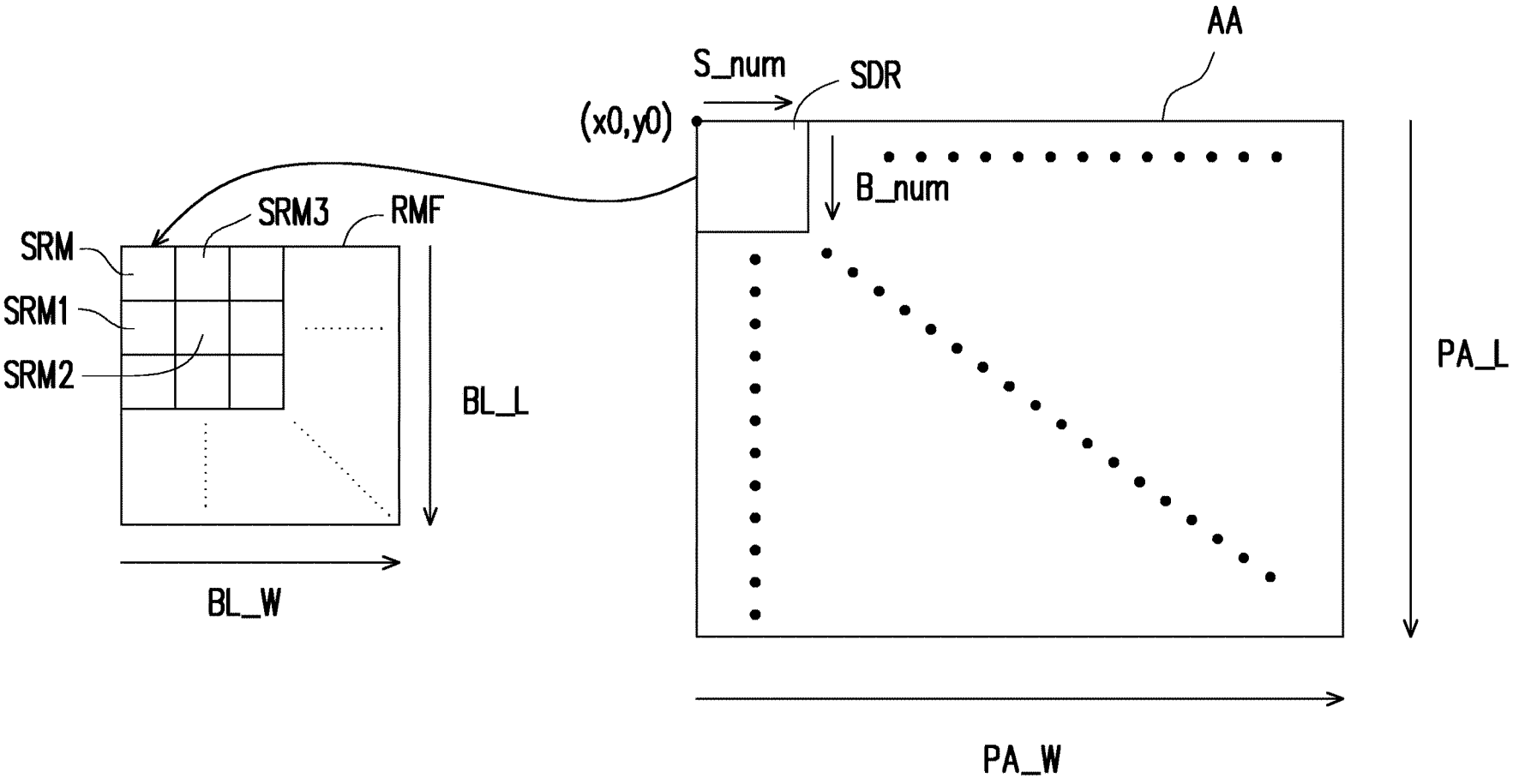
FIG. 1B is a schematic diagram illustrating a corresponding relation between the refresh mark table and the display region according to an embodiment of FIG. 1 in the disclosure.

Operations of devices of the display apparatus 100 are described as follows. With reference to FIG. 1A and FIG. 1B together, FIG. 1B is a schematic diagram illustrating a corresponding relation between the refresh mark table and the display region according to the embodiment of FIG. 1 in the disclosure. In this embodiment, the timing controller 120 sets the refresh marks in the refresh mark table RMF in the refresh mark controller 120, so that the refresh marks correspond to the sub-regions in the display region AA of the display panel 110. For instance, the sub-region SDR of the embodiment corresponds to the refresh mark SRM, and the timing controller 120 sets the mapping ratio to be provided between the refresh mark SRM and the corresponding sub-region SDR. Note that in other embodiments of the disclosure, the sub-region SDR may also correspond to a plurality of refresh marks SRM, SRM1, SRM2, and SRM3. That is, people having ordinary skill in the art may adjust the number of sub-regions corresponding to the refresh marks according to actual applications, and illustration of FIG. 1B acts as an exemplary example for description only and is not intended to limit the disclosure.

In addition, note that the timing controller 120 may determine a corresponding relation between the display region AA and the refresh mark table RMF through setting a value of the mapping ratio. That is, in the disclosure, length information PA_L and width information PA_W of the display region AA originally having a relatively large area may be reduced through the mapping ratio, and as such, length information BL_L and width information BL_W of the refresh mark table RMF having a relatively small area are set. Herein, the pixel controller 122 may treat length information B_num and width information S_num of a single sub-region in the display region AA as a benchmark and identifies the specific refresh mark in the refresh mark table RMF corresponding to the specific sub-region according to the mapping ratio. A unit of the length information B_num of the single sub-region is a pixel, and a unit of the width information S_num of the single sub-region is a line.

That is, in this embodiment, each of the refresh marks includes address information. The pixel controller 122 may adjust the address information according to the mapping ratio (e.g., enlarging the address information by one scale factor of the mapping ratio) to obtain one of the sub-regions corresponding to one of the refresh marks. Further, the address information records coordinate information of one of the refresh marks (e.g., the refresh mark SRM). The pixel controller 122 may obtain coordinate information, length information, and width information of one of the sub-regions (e.g., the sub-region SDR) from one of the refresh marks according to the mapping ratio.

Specifically, the refresh mark controller 121 determines whether the sub-region SDR is required to be refreshed according to the image signal IMS. That is, the sub-region SDR acts as the specific sub-region at this time, and the refresh mark SRM corresponding to the sub-region SDR acts as the specific refresh mark. At the same time, based on the coordinate information, the length information, and the width information of the sub-region SDR, the timing controller 121 may set the coordinate information in the address information of the refresh mark SRM according to the mapping ratio. For instance, according to horizontal axis coordinate information x0 (a "pixel" acts as the unit of the horizontal axis coordinate information x0) of the sub-region SDR, vertical axis coordinate information y0 (a "line" acts as the unit of the vertical axis coordinate information y0) of the sub-region SDR, the length information B_num (i.e., a B_num*1 pixel) of the sub-region SDR, and the width information S_num (i.e., a S_num*1 line) of the sub-region SDR, the timing controller 121 may set the coordinate information in the address information of the refresh mark SRM according to the mapping ratio. As such, the pixel controller 122 may identify the address information of the refresh mark SRM corresponding to the sub-region SDR. Next, when sequentially looking up whether the refresh marks in the refresh mark table RMF are adjusted, the pixel controller 122 may enlarge the address information by one scale factor of the mapping ratio based on the coordinate information in the address information of the adjusted refresh mark (e.g., the refresh mark SRM) according to the mapping ratio, so as to obtain the coordinate information, the length information, and the width information of the corresponding sub-region (e.g., the sub-region SDR) and performs the pixel refresh operation to the sub-region SDR.

In this way, in the display apparatus 100 of this embodiment, the refresh mark table RMF requiring less memory space may be used to manage the sub-regions in the display region AA, and that reduced memory space is thus needed. Further, since the area of the refresh mark table RMF is less than that of the display region AA, the pixel controller 122 may quickly identify the refresh marks adjusted as a first numerical value in the entire refresh mark table RMF. As such, the display panel 110 displays the corresponding sub-regions, and that efficiency of searching for effective pixel information (e.g., the pixels required to be refreshed) is significantly enhanced, and thereby, a size and complexity of an entire circuit structure are reduced.

Figure 2:
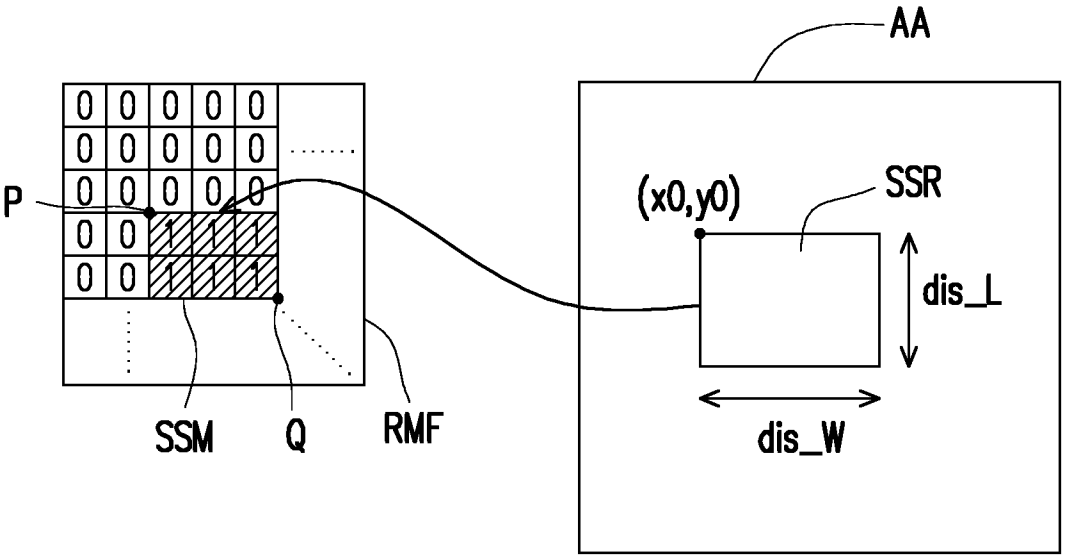
FIG. 2 is a schematic diagram illustrating a pixel refresh operation performed by the display apparatus according to the embodiment of FIG. 1 in the disclosure.

Next, with reference to FIG. 1A and FIG. 2 together, FIG. 2 is a schematic diagram illustrating a pixel refresh operation performed by the display apparatus according to the embodiment of FIG. 1 in the disclosure. When the timing controller 120 receives the image signal IMS, the refresh mark controller 121 determines whether the sub-regions in the display region AA are refreshed according to frame data in the image signal IMS. For instance, when the refresh mark controller 121 determines that a sub-region SSR in the display region AA needs to be refreshed according to the frame data in the image signal IMS, that is, the refresh mark controller 121 treats the sub-region SSR as the specific sub-region at this time. Next, the refresh mark controller 121 responds to the specific sub-region required to be refreshed, so as to adjust a specific refresh mark SSM according to the mapping ratio. Herein, the sub-region SSR corresponds to the specific refresh mark SSM among the refresh marks in the refresh mark table RMF. Further, the sub-region SSR may include at least one of the sub-regions, and the specific refresh mark SSM may include at least one of the refresh marks.

Specifically, when the refresh mark controller 121 determines that the sub-region SSR in the display region AA needs to be refreshed according to the frame data in the image signal IMS, the refresh mark controller 121 sets the address information of the specific refresh mark SSM in the refresh mark table RMF according to the mapping ratio based on the coordinate information of the sub-region SSR (i.e., the specific sub-region), such as the horizontal axis coordinate information x0 (e.g., S_num*2 pixels≤x0≤S_num*3 pixels), the vertical axis coordinate information y0 (e.g., B_num*3 lines≤y0≤B_num*4 lines), length information dis_L of the sub-region SSR, and width information dis_W of the sub-region SSR.

Operations of setting the address information of the specific refresh mark SSM in the refresh mark table RMF according to the mapping ratio are described as follows. First, after the horizontal axis coordinate information 0 and the vertical axis coordinate information y0 in the sub-region SSR are divided by the mapping ratio, a coordinate point (i.e., a coordinate point P) corresponding to such coordinate information in the refresh mark table RMF may be identified. Next, the horizontal axis coordinate information x0 of the sub-region SSR is added to the width information dis_W of the sub-region SSR (e.g., S_num*4≤coordinate information x0+width information dis_W≤S_num*5) and then is divided by the mapping ratio, and the vertical axis coordinate information y0 in the sub-region SSR is added to the length information dis_L of the sub-region SSR (e.g., B_num*4≤coordinate information y0+length information dis_L≤B_num*5) and is divided by the mapping ratio. In this way, a coordinate point (i.e., a coordinate point Q) is correspondingly identified after the coordinate point P is added to the width information dis_W and the length information dis_L in the refresh mark table RMF. Accordingly, a location (i.e., a length between the coordinate point P and the coordinate point Q is 2 refresh marks, a width therebetween is a region of 3 refresh marks) of the specific refresh mark SSM in the refresh mark table RMF is thereby identified, and the coordinate information of the coordinate point P is correspondingly stored to act as the address information of the specific refresh mark SSM.

In other words, based on the coordinate information (i.e., the horizontal axis coordinate information x0 and the vertical axis coordinate information 0), the length information dis_L, and the width information dis_W of the sub-region SSR, the refresh mark controller 121 may identify that the coordinate information of the coordinate point P (i.e., a starting point) in the specific refresh mark SSM in the corresponding refresh mark table RMF is the second point counting from the left side and the third point counting from the upper side of the refresh mark table RMF and may identify that the coordinate information of the coordinate point Q (i.e., an ending point) in the specific refresh mark SSM is the fifth point counting from the left side and the fifth point counting from the upper side, so as to identify the location of the specific refresh mark SSM corresponding to the sub-region SSR in the refresh mark table RMF. Next, the refresh mark controller 121 adjusts the refresh marks (i.e., the refresh marks in the slash region in FIG. 2) in the specific refresh mark SSM to the first numerical values (e.g., 1) from the predetermined second numerical values (e.g., 0). Next, the pixel controller 122 sequentially looks up whether the refresh marks in the refresh mark table RMF are adjusted (i.e., whether the numerical value in the refresh mark table is adjusted to 1), so as to obtain the sub-region (i.e., the sub-region SSR) corresponding to the adjusted refresh marks (i.e., the refresh marks in the specific refresh mark SSM) according to the mapping ratio and performs the pixel refresh operation to the sub-region SSR. In addition, after the pixel controller 122 completes the pixel refresh operation to the sub-region SSR, the pixel controller 122 modifies the refresh marks in the specific refresh mark SSM corresponding to the sub-region SSR from an adjusted state (i.e., 1) to an unadjusted state (i.e., 0).

Figure 3A:
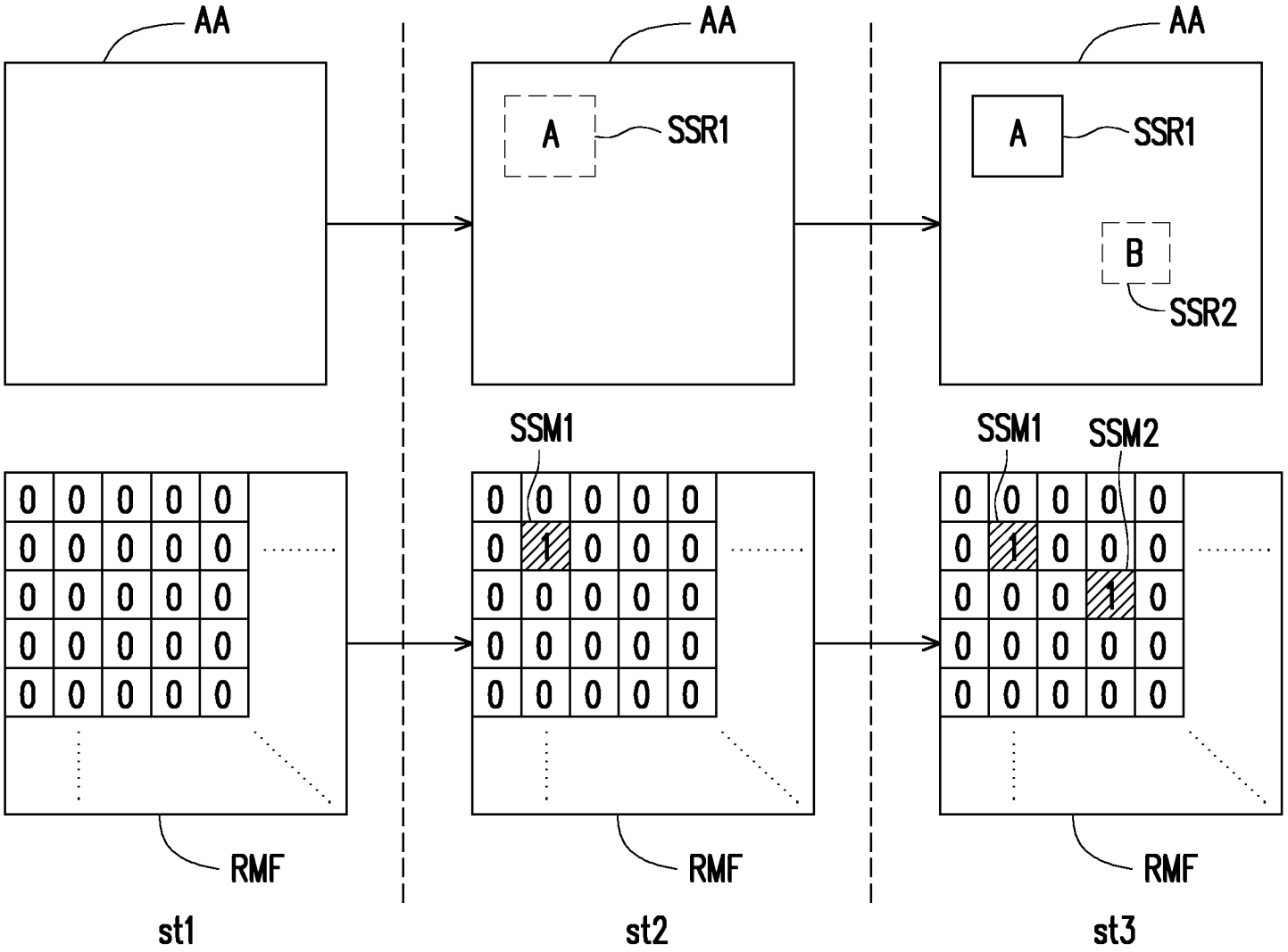
FIG. 3A to FIG. 3B are schematic diagrams illustrating simultaneous pixel refresh operations performed by the display apparatus according to the embodiment of FIG. 1 in the disclosure.
Figure 3B:
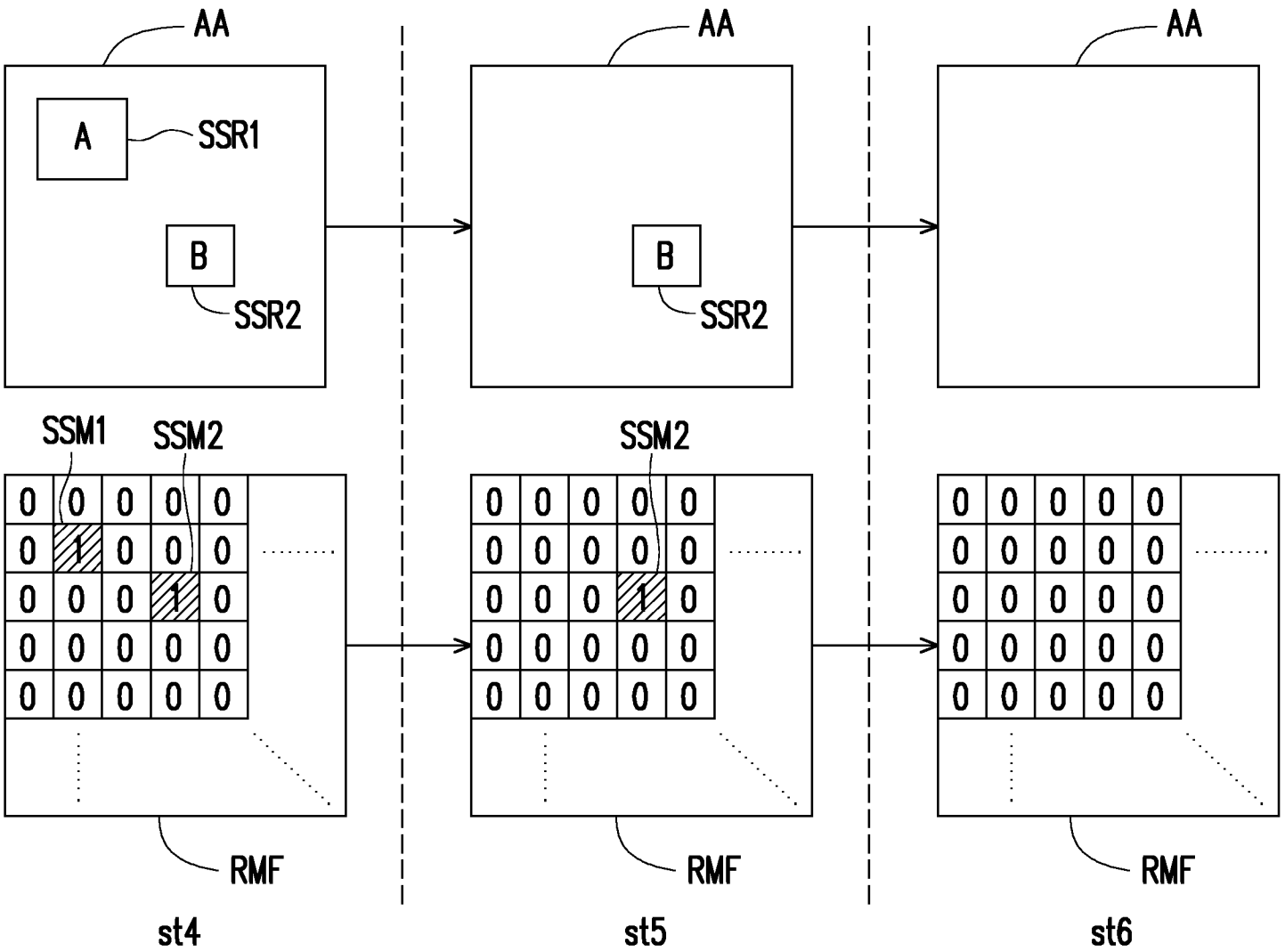

With reference to FIG. 1, FIG. 3A, and FIG. 3B together, FIG. 3A to FIG. 3B are schematic diagrams illustrating simultaneous pixel refresh operations performed by the display apparatus according to the embodiment of FIG. 1 in the disclosure. In this application example, the display region AA of the display panel 110 in the display apparatus 100 is in a standby state in a stage St1, and at the same time, the refresh marks in the refresh mark table RMF are all in the unadjusted state. That is, the numerical value in each of the refresh marks is the predetermined second numerical value (i.e., 0). Next, in a stage St2 after the stage St1, the timing controller 120 receives the image signal IMS. Further, the refresh mark controller 121 determines that a sub-region A among the sub-regions in the display region AA is required to be refreshed (i.e., the dotted line frame in the display region AA in the stage st2 of FIG. 3A) according to the frame data in the image signal IMS. At this time, the refresh mark controller 121 sets the sub-region A as a specific sub-region SSR1 and then responds to the specific sub-region SSR1 required to be refreshed to adjust a specific refresh mark SSM1 in the corresponding refresh mark table RMF according to the mapping ratio, so as to mark a refresh mark in the specific refresh mark SSM1 as the first numerical value (i.e., 1). That is, the specific sub-region SSR1 corresponds to the specific refresh mark SSM1, and the refresh mark controller 121 sets the address information of the specific refresh mark SSM1 according to the mapping ratio based on the coordinate information, the length information, and the width information in the specific sub-region SSR1. Note that the manner used to set the address information of the specific sub-region is similar to that used in the application examples of FIG. 2 and thus is not repeated herein.

Next, the pixel controller 122 sequentially looks up whether the refresh marks in the refresh mark table RMF are adjusted and obtains the specific sub-region SSR1 corresponding to the adjusted refresh marks (i.e., the refresh marks in the specific refresh mark SSM1) according to the mapping ratio, and performs the pixel refresh operation to the sub-region in the specific sub-region SSR1 (i.e., the sub-region A), so as to display the image signal IMS on the display panel 110.

In a stage St3 after the stage St2, when the pixel refresh operation is performed to the sub-region A in the specific sub-region SSR1 (i.e., the solid line frame in the display region AA in stage st3 of FIG. 3A), the timing controller 120 receives another piece of frame data among a plurality of pieces of frame data in the image signal IMS. The refresh mark controller 121 then determines whether a sub-region B among the sub-regions in the display region AA needs to be refreshed according to the another piece of frame data (i.e., the dotted line frame in the display region AA in the stage st3 of FIG. 3A) and sets the sub-region B as another specific sub-region SSR2. Next, the refresh mark controller 121 responds to the specific sub-region SSR2 required to be refreshed, so as to adjust the specific refresh mark SSM2 in the corresponding refresh mark table RMF according to the mapping ratio and to mark the refresh mark in the specific refresh mark SSM2 as the first numerical value (i.e., 1). That is, the specific sub-region SSR2 corresponds to the specific refresh mark SSM2 at this time, and the refresh mark controller 121 sets the address information of the specific refresh mark SSM2 according to the mapping ratio based on the coordinate information, the length information, and the width information in the specific sub-region SSR2. Note that the manner used to set the address information of the specific sub-region is similar to that used in the application examples of FIG. 2 as well and thus is not repeated herein.

Next, with reference to FIG. 1 and FIG. 3B together, in a stage St4 after the stage St3, the pixel controller 122 sequentially looks up whether the refresh marks in the refresh mark table RMF are adjusted as well and obtains the specific sub-region SSR2 corresponding to the adjusted refresh marks (i.e., the refresh marks in the specific refresh mark SSM2) according to the mapping ratio and performs the pixel refresh operation to the specific sub-region SSR2 (i.e., the sub-region B), so as to simultaneously display the specific sub-region SSR1 and the specific sub-region SSR2 (i.e., the solid line frames in the display region AA in the stage st4 of FIG. 3B) to be displayed by the image signal IMS in the display panel 110. Next, in a stage St5 after the stage St3, when the pixel refresh operation is performed to the specific sub-region SSR1, the pixel controller 122 modifies the specific refresh mark SSM1 corresponding to the specific sub-region SSR1 from the adjusted state to the unadjusted state. That is, the numerical values of the refresh marks in the specific refresh mark SSM1 are adjusted to the predetermined second numerical value (i.e., 0).

In other words, when the pixel controller 122 performs the pixel refresh operation to the specific sub-region SSR1, marking of the specific refresh mark SSM1 corresponding to the specific sub-region SSR1 is completed and the specific refresh mark SSM1 can be modified back to the unadjusted state (i.e., the second numerical value 0), so as to wait for the pixel refresh operation of the next frame data of the image signal IMS. After the pixel refresh operation of the specific sub-region SSR1 is completed, only the sub-region SSR1 (i.e., the sub-region B) is left in the display region AA for the pixel refresh operation. In the next stage (i.e., a stage St6), when the pixel controller 122 performs the pixel refresh operation to the specific sub-region SSR2, marking of the specific refresh mark SSM2 corresponding to the specific sub-region SSR2 is completed and the specific refresh mark SSM2 can be modified back to the unadjusted state (i.e., the second numerical value 0), so as to wait for the pixel refresh operation of the next frame data of the image signal IMS. After the pixel refresh operation of the specific sub-region SSR2 is completed, the display region AA returns back to the original standby state, so as to wait for the pixel refresh operation of the next frame data of the image signal IMS. Note that the 6 stages St1 to St6 depicted in FIG. 3A to FIG. 3B in the disclosure act as exemplary examples only, and the disclosure does not intend to limit the simultaneous pixel refresh operations to the 6 stages or to be performed in a stage by stage manner in practice. That is, illustrations of FIG. 3A to FIG. 3B are not intended to limit the disclosure.

In this way, in the disclosure, the refresh mark controller 121 may be used to simultaneously adjust the specific refresh marks (i.e., the specific refresh marks SSM1 and SSM2) in the refresh mark table RMF corresponding to the specific sub-regions (i.e., the specific sub-regions SSR1 and SSR2) according to the image signal IMS, so as to display multiple pieces of frame data in the signal image IMS. Further, memory space is saved, the circuit structure is simplified, and efficiency of searching is enhanced.

Figure 4:
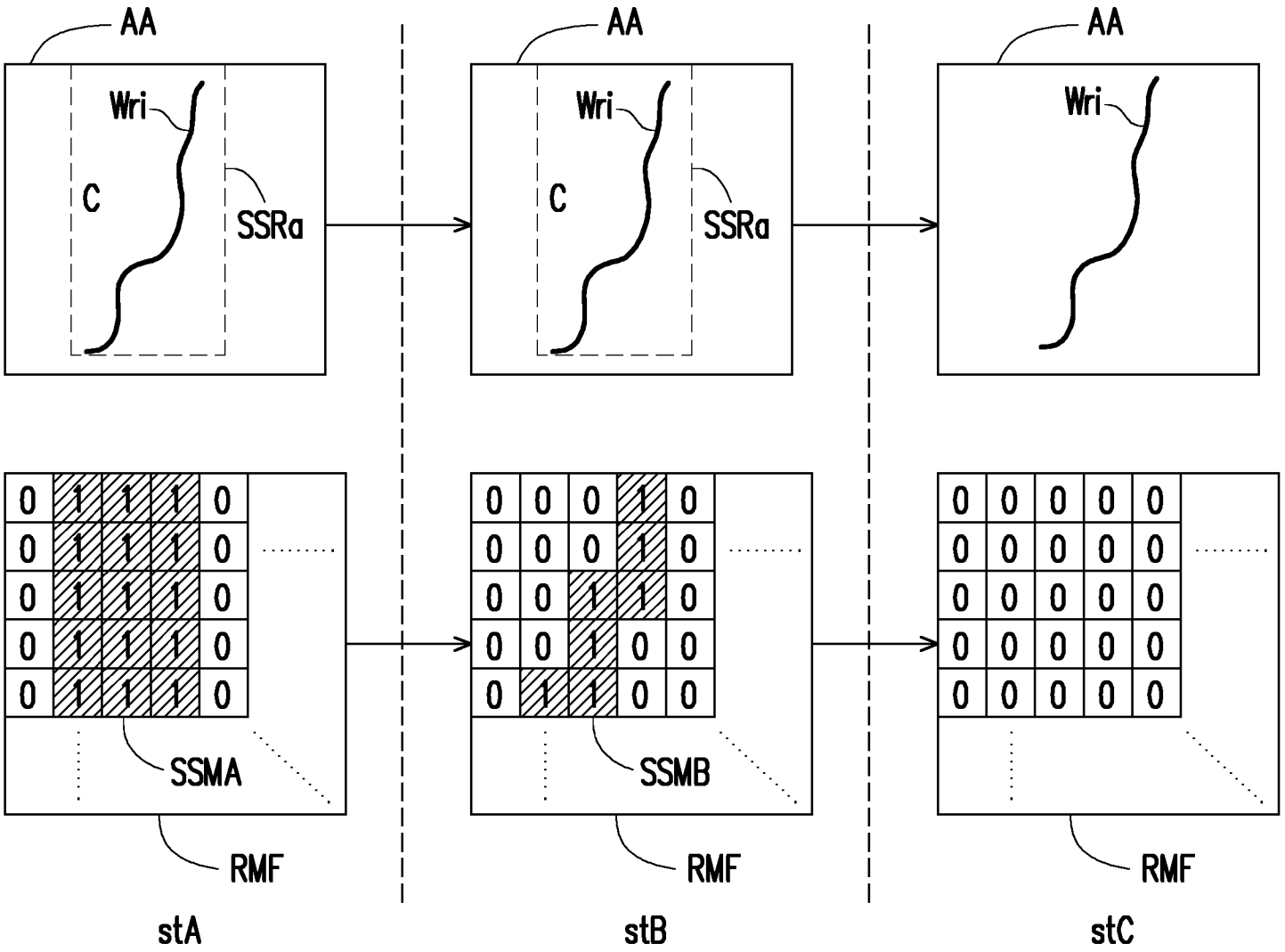
FIG. 4 is a schematic diagram illustrating the pixel refresh operation of a handwriting application scenario performed by the display apparatus according to the embodiment of FIG. 1 in the disclosure.

With reference to FIG. 1 and FIG. 4, FIG. 4 is a schematic diagram illustrating the pixel refresh operation of a handwriting application scenario performed by the display apparatus according to the embodiment of FIG. 1 in the disclosure. In this embodiment, when the display apparatus 100 enters the handwriting application scenario, a user may perform a handwriting input action on the display panel 110. Specifically, when the user draws a picture (e.g., a picture Wri) in the display region AA of the display panel 110, the timing controller 120 receives the image signal IMS corresponding to the picture Wri in a stage StA. Further, the refresh mark controller 121 determines that a sub-region C among the sub-regions in the display region AA is required to be refreshed according to the frame data in the image signal IMS and treats the sub-region C as a specific sub-region SSRa. Next, the specific sub-region SSR2 required to be refreshed is responded, so that a specific refresh mark SSMA in the corresponding refresh mark table RMF is adjusted according to the mapping ratio, and as such, the refresh marks in the specific refresh mark SSMA is marked as the first numerical value (i.e., 1).

In a stage StB after the stage StA, the refresh mark controller 121 scans to the refresh mark table RMF. The refresh mark controller 121 further compares current frame data (i.e., the picture Wri) in the image signal IMS with previous frame data in the image signal IMS (i.e., the image signal IMS without any pictures on the display panel 110 drawn by the user), determines a change between the current frame data and the previous frame data, and adjusts the refresh marks without any change (i.e., the refresh marks corresponding to the sub-regions with the same display locations in the current frame data and the previous frame data) from the first numerical value (i.e., 1) back to the second numerical value (i.e., 0), so as to determine the sub-region required to be refreshed (i.e., the specific sub-region SSRa) for displaying the picture Wri.

Further, when the refresh mark controller 121 makes comparison, the refresh mark controller 121 determines that only the sub-region corresponding to the picture Wri in the sub-region C is required to be displayed, and an original display state is maintained for the rest of the blank background. That is, the rest of the blank background is not required to be changed. Accordingly, the refresh mark controller 121 may determine that only the picture Wri is required to be changed in the sub-region C at this time. That is, only the numerical values of part of the refresh marks in the specific refresh mark SSMA are required to be adjusted to the first numerical value (i.e., 1). The refresh mark controller 121 then adjusts the refresh marks in the refresh mark table RMF corresponding to the blank background in the sub-region C to the second numerical value (i.e., 0), so as to adjust the specific refresh mark SSMA to a specific refresh mark SSMB. After displaying is completed, a stage StC is performed after the stage StB, and that the specific refresh mark SSMB is adjusted back to the second numerical value (i.e., 0), and displaying and scanning are thereby fully completed.

Next, the pixel controller 122 sequentially looks up whether the refresh marks in the refresh mark table RMF are adjusted and obtains the sub-regions corresponding to the picture Wri in the specific sub-region SSRa corresponding to the adjusted refresh marks (i.e., the refresh marks in the specific refresh mark SSMB) according to the mapping ratio, and performs the pixel refresh operation to the sub-regions corresponding to the picture Wri, so as to display the picture Wri to be correspondingly displayed by the image signal IMS on the display panel 110. In a stage StC after the stage StB, when the pixel controller 122 performs the pixel refresh operation to the specific sub-region SSRa, the pixel controller 122 modifies the refresh marks in the specific refresh mark SSMB corresponding to specific sub-region SSRa of which the pixel refresh operation is completed to the unadjusted state (i.e., the second numerical value 0), so as to modify the refresh mark table RMF to the standby state to wait for the pixel refresh operation of the next frame data of the image signal IMS. Note that the 3 stages StA to StC depicted in FIG. 4 in the disclosure act as exemplary examples only, and the disclosure does not intend to limit the pixel refresh operations of the handwriting application scenario to the 3 stages only or to be performed in a stage by stage manner in practice. That is, the illustration of FIG. 4 is not intended to limit the disclosure.

In this way, in the disclosure, the refresh mark controller 121 is used to adjust the specific refresh marks (i.e., the specific refresh mark SSMB) in the refresh mark table RMF corresponding to the specific sub-region SSRa (i.e., the sub-region C) according to the picture (i.e., the picture Wri) depicted by the user. The refresh mark controller 121 is further used to scan and compare among the multiple pieces of frame data in the image signal IMS, so that the picture Wri is displayed with a minimum number of refresh marks. In this way, memory space is significantly saved, the circuit structure is simplified, and efficiency of searching is enhanced.

Figure 5:
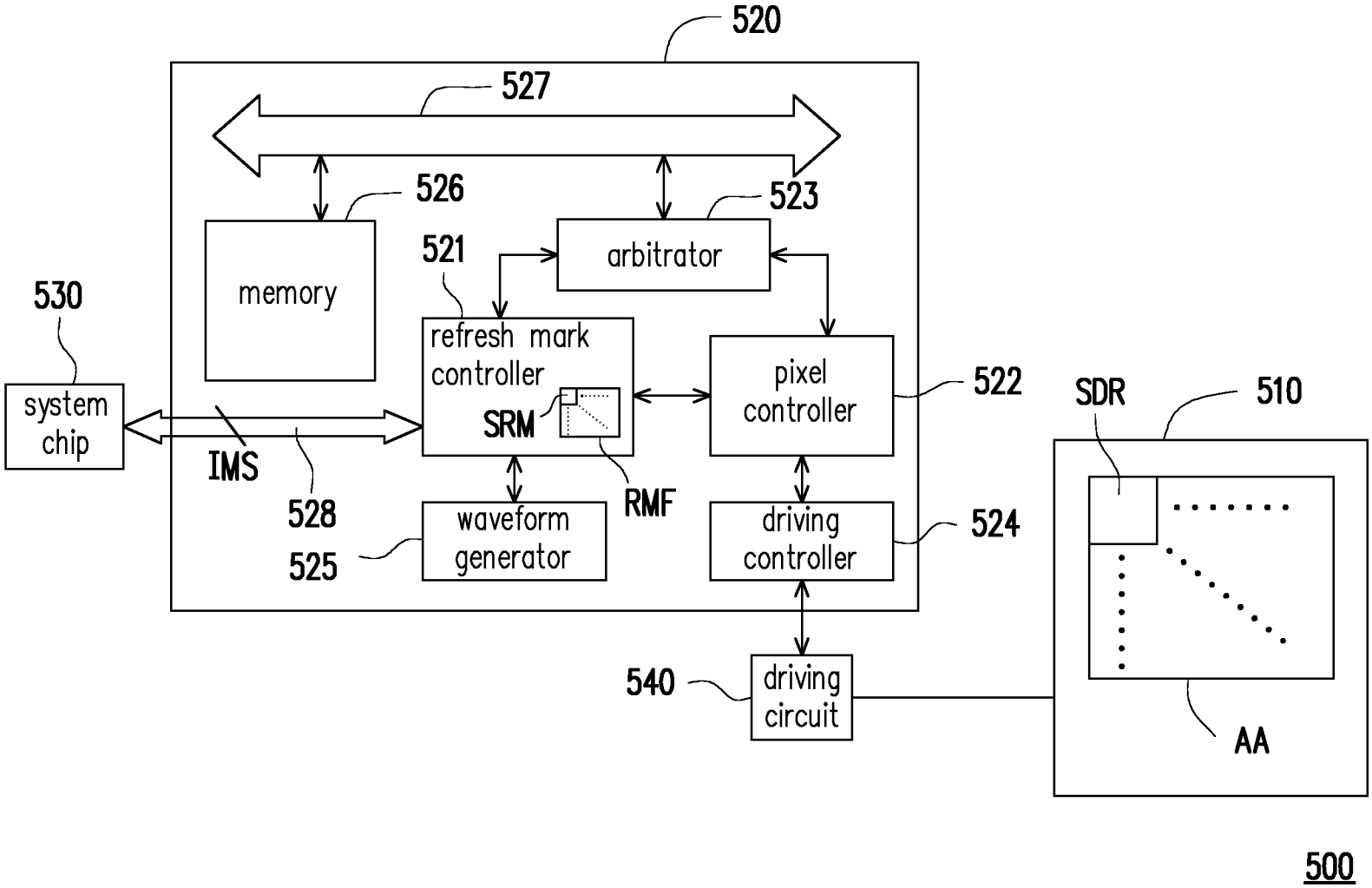
FIG. 5 is a schematic diagram illustrating a display apparatus according to another embodiment of the disclosure.

With reference to FIG. 5, FIG. 5 is a schematic diagram illustrating a display apparatus according to another embodiment of the disclosure. The difference between this embodiment and the embodiment of FIG. 1 is that a display apparatus 500 of this embodiment includes a display panel 510, a timing controller 520, a system chip 530, and a driving circuit 540. The timing controller 520 is coupled between the system chip 530 and the driving circuit 540 and is coupled to the display panel 510 through the driving circuit 540. The timing controller 520 receives the image signal IMS from the system chip 530 to output a driving control signal to control the driving circuit 540, so that the driving circuit 540 drives the display panel 510 to display the image signal IMS.

Specifically, the timing controller 520 includes a refresh mark controller 521, a pixel controller 522, an arbitrator 523, a driving controller 524, a waveform generator 525, a memory 526, a first bus 527, and a second bus 528. The first bus 527 is coupled to the memory and is configured to transmit a plurality of pieces of frame data of the image signal IMS between the arbitrator 523 and the memory 526. The arbitrator 523 is coupled among the first bus 527, the pixel controller 522, and the refresh mark controller 521 and is configured to control data transmission of the first bus 527. For instance, the arbitrator 523 may control pixel information stored and temporarily stored by the refresh mark controller 521 at this time or read the pixel information in the memory 526 or may control the pixel information stored and temporarily stored by the pixel controller 522 at this time or read the pixel information in the memory 526. The second bus 528 is coupled between the refresh mark controller 521 and the system chip 530 and is configured to transmit the image signal IMS, so that the system chip 530 may set the address information of refresh marks of the refresh mark table RMF in the refresh mark controller 521 through the second bus 528. The driving controller 524 is coupled to the pixel controller 522 and is configured to transmit a driving control signal to the driving circuit 540 according to a command of the pixel controller 522, so as to control the driving circuit 540 to drive the display panel 510 to perform the pixel refresh operation.

The waveform generator 525 is coupled to the refresh mark controller 521 and is configured to generate and provide a plurality of display signal waveforms to the refresh mark controller 521. The driving controller 521 is coupled to the pixel controller 522 and is configured to transmit the driving control signal to the driving circuit 540 to control the driving circuit 540. The memory 526 is configured to store or temporarily store the frame data in the image signal IMS. The refresh mark controller 521 determines whether the sub-regions in the display region AA are refreshed according to the frame data of the image signal IMS temporarily stored in the memory 526. The pixel controller 522 obtains the pixel information corresponding to the sub-regions from the memory 526 and refreshes each pixel in the sub-regions when performing the pixel refresh operation to the sub-regions.

Note that the pixel refresh operation performed by the display apparatus 500 according to the image signal IMS is similar to that performed by the display apparatus 100, and repeated description is thus omitted herein.

Figure 6:
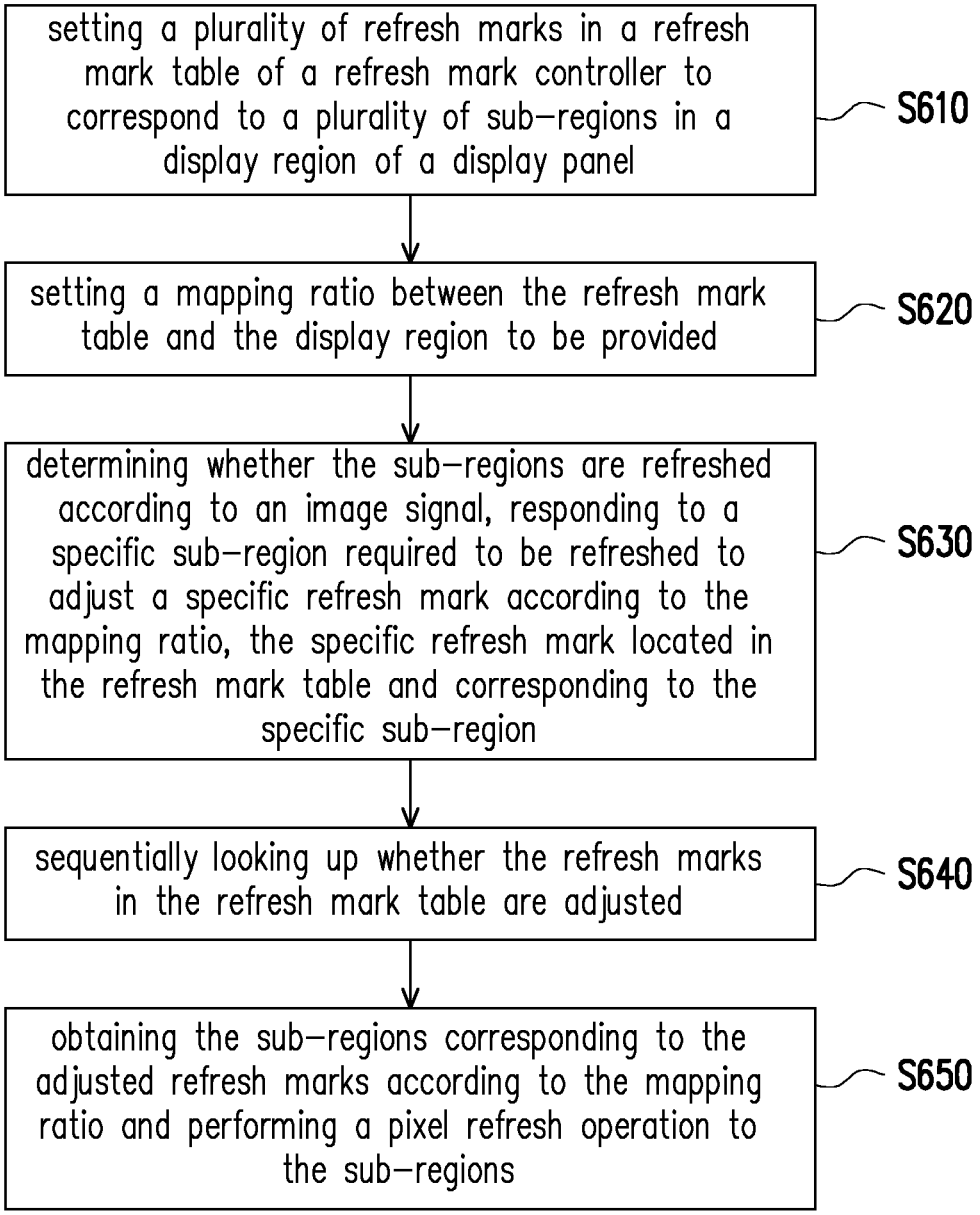
FIG. 6 is a flow chart illustrating an operation method of a display apparatus according to an embodiment of the disclosure.

With reference to FIG. 6, FIG. 6 is a flow chart illustrating an operation method of a display apparatus according to an embodiment of the disclosure. In step S610, a plurality of refresh marks in a refresh mark table in a refresh mark controller are set to correspond to a plurality of sub-regions in a display region of the display panel, and a mapping ratio is set to be provided between the refresh mark table and the display region in step S620. Next, in step S630, whether the sub-regions are refreshed are determined according to an image signal, a specific sub-region required to be refreshed is responded to adjust a specific refresh mark according to the mapping ratio, and the specific refresh mark is located in the refresh mark table and corresponds to the specific sub-region. In step S640, whether the refresh marks in the refresh mark table are adjusted are sequentially looked up, and the sub-regions corresponding to the adjusted refresh marks are obtained according to the mapping ratio and a pixel refresh operation is performed to the sub-regions in step S650.

Implementation details of step S610 to step S650 are thoroughly described in the foregoing embodiments and examples and thus are not repeated herein.

In view of the foregoing, in the disclosure, the timing controller is used to receive the image signal. The refresh mark controller is then used to determine whether the sub-regions in the display region in the display panel are required to be refreshed according to the image signal and responds to the specific sub-region required to be refreshed to adjust the specific refresh mark according to the mapping ratio. The pixel controller is further used to sequentially look up whether the refresh marks in the refresh mark table are adjusted, obtains the sub-regions corresponding to the adjusted refresh marks according to the mapping ratio, and performs the pixel refresh operation to the sub-regions. Accordingly, in the disclosure, the sub-regions in the display region may be managed through the refresh marks requiring less capacity, and in this way, the circuit is simplified, less memory space is used, and efficiency of searching for the pixel information is enhanced.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A display apparatus, comprising:

a display panel, comprising a display region; and a timing controller, coupled to the display panel, the timing controller receiving an image signal and using the display panel to display the image signal, wherein the timing controller comprises:

a refresh mark controller, comprising a refresh mark table, wherein a plurality of refresh marks in the refresh mark table correspond to a plurality of sub-regions of the display region, a mapping ratio is provided between the refresh mark table and the display region, wherein the mapping ratio is a zoom scale factor of the refresh marks in the refresh mark table to the sub-regions in the display region, the refresh mark controller determines whether the sub-regions are refreshed according to the image signal and responds to a specific sub-region required to be refreshed to adjust a specific refresh mark according to the mapping ratio, and the specific refresh mark is located in the refresh mark table and corresponds to the specific sub-region; and a pixel controller, coupled to the refresh mark controller, wherein the pixel controller sequentially looks up whether the refresh marks in the refresh mark table are adjusted, obtains the sub-regions corresponding to the adjusted refresh marks according to the mapping ratio, and performs a pixel refresh operation to the sub-regions.

2. The display apparatus as claimed in claim 1, wherein the pixel controller modifies the refresh marks corresponding to the sub-regions from an adjusted state to an unadjusted state after the pixel controller completes the pixel refresh operation to the sub-regions.

3. The display apparatus as claimed in claim 1, wherein the specific sub-region is at least one of the sub-regions.

4. The display apparatus as claimed in claim 1, wherein the display apparatus further comprises:

a memory, configured to store or temporarily store a plurality of pieces of frame data in the image signal, wherein the refresh mark controller determines whether the sub-regions are refreshed according to the frame data in the memory, and the pixel controller obtains pixel information corresponding to the sub-regions from the memory and refreshes each pixel in the sub-regions when performing the pixel refresh operation to the sub-regions.

5. The display apparatus as claimed in claim 4, wherein the timing controller further comprises:

a first bus, coupled to the memory, configured to transmit the frame data;

an arbitrator, coupled among the first bus, the pixel controller, and the refresh mark controller, configured to control data transmission of the first bus;

a waveform generator, coupled to the refresh mark controller, configured to generate a plurality of display signal waveforms;

a driving controller, coupled to the pixel controller, configured to transmit a driving control signal to a driving circuit to control the driving circuit; and a second bus, coupled between the refresh mark controller and a system chip, configured to transmit the image signal.

6. The display apparatus as claimed in claim 1, wherein each of the refresh marks comprises address information, and the pixel controller adjusts the address information according to the mapping ratio to obtain at least one of the sub-regions corresponding to at least one of the refresh marks.

7. The display apparatus as claimed in claim 6, wherein the address information records coordinate information of one of the refresh marks, and the pixel controller obtains coordinate information, length information, and width information of one of the sub-regions from one of the refresh marks according to the mapping ratio.

8. The display apparatus as claimed in claim 1, wherein the adjusted refresh marks are marked as a first numerical value, and the unadjusted refresh marks are marked as a second numerical value.

9. The display apparatus as claimed in claim 1, wherein the display apparatus is an e-paper electronic apparatus, and the display panel is a bistable display panel.

10. A timing controller, adapted to receive an image signal and use a display panel of a display apparatus to display the image signal, the timing controller comprises:

a refresh mark controller, comprising a refresh mark table, wherein a plurality of refresh marks in the refresh mark table correspond to a plurality of sub-regions of the display region in the display panel, a mapping ratio is provided between the refresh mark table and the display region, wherein the mapping ratio is a zoom scale factor of the refresh marks in the refresh mark table to the sub-regions in the display region, the refresh mark controller determines whether the sub-regions are refreshed according to the image signal and responds to a specific sub-region required to be refreshed to adjust a specific refresh mark according to the mapping ratio, and the specific refresh mark is located in the refresh mark table and corresponds to the specific sub-region; and a pixel controller, coupled to the refresh mark controller, wherein the pixel controller sequentially looks up whether the refresh marks in the refresh mark table are adjusted, obtains the sub-regions corresponding to the adjusted refresh marks according to the mapping ratio, and performs a pixel refresh operation to the sub-regions.

11. The timing controller as claimed in claim 10, wherein the pixel controller modifies the refresh marks corresponding to the sub-regions from an adjusted state to an unadjusted state after the pixel controller completes the pixel refresh operation to the sub-regions.

12. The timing controller as claimed in claim 10, wherein the specific sub-region is at least one of the sub-regions.

13. The timing controller as claimed in claim 10, wherein the timing controller further comprises:

a memory, configured to store or temporarily store a plurality of pieces of frame data in the image signal, wherein the refresh mark controller determines whether the sub-regions are refreshed according to the frame data in the memory, and the pixel controller obtains pixel information corresponding to the sub-regions from the memory and refreshes each pixel in the sub-regions when performing the pixel refresh operation to the sub-regions.

14. The timing controller as claimed in claim 13, wherein the timing controller further comprises:

a first bus, coupled to the memory, configured to transmit the frame data;

an arbitrator, coupled among the first bus, the pixel controller, and the refresh mark controller, configured to control data transmission of the first bus;

a waveform generator, coupled to the refresh mark controller, configured to generate a plurality of display signal waveforms;

a driving controller, coupled to the pixel controller, configured to transmit a driving control signal to a driving circuit to control the driving circuit; and a second bus, coupled between the refresh mark controller and a system chip, configured to transmit the image signal.

15. The timing controller as claimed in claim 10, wherein each of the refresh marks comprises address information, and the pixel controller adjusts the address information according to the mapping ratio to obtain at least one of the sub-regions corresponding to at least one of the refresh marks.

16. The timing controller as claimed in claim 15, wherein the address information records coordinate information of one of the refresh marks, and the pixel controller obtains coordinate information, length information, and width information of one of the sub-regions from one of the refresh marks according to the mapping ratio.

17. The timing controller as claimed in claim 10, wherein the adjusted refresh marks are marked as a first numerical value, and the unadjusted refresh marks are marked as a second numerical value.

18. An operation method of a display apparatus, wherein the display apparatus comprises a timing controller and a display panel, wherein the timing controller comprises a refresh mark controller and a pixel controller, and the operation method comprises:

setting a plurality of refresh marks in a refresh mark table of the refresh mark controller to correspond to a plurality of sub-regions in a display region of the display panel;

setting a mapping ratio between the refresh mark table and the display region to be provided, wherein the mapping ratio is a zoom scale factor of the refresh marks in the refresh mark table to the sub-regions in the display region;

determining whether the sub-regions are refreshed according to an image signal, responding to a specific sub-region required to be refreshed to adjust a specific refresh mark according to the mapping ratio, the specific refresh mark located in the refresh mark table and corresponding to the specific sub-region;

sequentially looking up whether the refresh marks in the refresh mark table are adjusted; and obtaining the sub-regions corresponding to the adjusted refresh marks according to the mapping ratio and performing a pixel refresh operation to the sub-regions.

19. The operation method of the display apparatus as claimed in claim 18, wherein after the pixel controller completes the pixel refresh operation to the sub-regions, the operation method further comprises:

modifying an adjusted state of the refresh marks corresponding to the sub-regions to an unadjusted state.

20. The operation method of the display apparatus as claimed in claim 18, wherein each of the refresh marks comprises address information, and the pixel controller adjusts the address information according to the mapping ratio to obtain at least one of the sub-regions corresponding to at least one of the refresh marks.

21. The operation method of the display apparatus as claimed in claim 20, wherein the address information records coordinate information of one of the refresh marks, and the pixel controller obtains coordinate information, length information, and width information of one of the sub-regions from one of the refresh marks according to the mapping ratio.

22. The operation method of the display apparatus as claimed in claim 18, wherein the adjusted refresh marks are marked as a first numerical value, and the unadjusted refresh marks are marked as a second numerical value.

* * * * *